US010371087B2

(12) United States Patent
Thrasher

(10) Patent No.: US 10,371,087 B2
(45) Date of Patent: Aug. 6, 2019

(54) DIE CAST CLOSED DECK ENGINE BLOCK MANUFACTURE

(71) Applicant: EXCO ENGINEERING, A DIVISION OF EXCO TECHNOLOGIES LIMITED, Newmarket (CA)

(72) Inventor: Jeffrey W. Thrasher, Newmarket (CA)

(73) Assignee: Exco Engineering, Newmarket, Ontario (CA)

( * ) Notice: Subject to any disclaimer, the term of this patent is extended or adjusted under 35 U.S.C. 154(b) by 269 days.

(21) Appl. No.: 15/232,998

(22) Filed: Aug. 10, 2016

(65) Prior Publication Data

US 2017/0045016 A1 Feb. 16, 2017

Related U.S. Application Data

(60) Provisional application No. 62/203,453, filed on Aug. 11, 2015.

(51) Int. Cl.

| | |
|---|---|
| ***F02F 7/00*** | (2006.01) |
| ***B22D 17/24*** | (2006.01) |
| ***B22D 17/22*** | (2006.01) |

(52) U.S. Cl.

CPC ..... *F02F 7/0095* (2013.01); *B22D 17/2263* (2013.01); *B22D 17/24* (2013.01);

(Continued)

(58) Field of Classification Search

CPC ..... F02F 2200/06; F02F 7/0095; F02F 7/007; B22D 17/2263; B22D 17/24

See application file for complete search history.

(56) References Cited

U.S. PATENT DOCUMENTS

| | | | |
|---|---|---|---|
| 4,446,906 | A | 5/1984 | Ackerman et al. |
| 4,686,943 | A | 8/1987 | Anno et al. |

(Continued)

FOREIGN PATENT DOCUMENTS

| | | | |
|---|---|---|---|
| DE | 10 2012 021072 | A1 | 4/2014 |
| EP | 0628716 | A1 | 12/1994 |

(Continued)

OTHER PUBLICATIONS

Machine Translation of German Patent No. DE 10 2012 021 072 A1 (Year: 2014).*

*Primary Examiner* — Christopher J Besler

(74) *Attorney, Agent, or Firm* — Michael Best & Friedrich LLP

(57) ABSTRACT

A first die segment for forming an internal combustion engine block has cylindrical projections, and die core pieces disposed about the cylindrical projections. A second die segment has die core stubs positioned so as to extend between adjacent die core pieces when the segments are brought together. An engine block formed by the die segments has cylindrical bores formed by the cylindrical projections extending from the deck of the block and voids formed by the die core pieces also extending from the deck and disposed about the cylindrical bores. Pockets formed by the die core stubs extend into sides of the engine block between adjacent voids. The engine block is worked below the level of the deck to undercut each of the pockets, removing material between them and the voids to result in an interconnected water jacket extending about the cylindrical bores, while leaving the deck closed.

13 Claims, 9 Drawing Sheets

(52) U.S. Cl.
CPC ..... *F02F 7/0007* (2013.01); *F02F 7/007* (2013.01); *F02F 7/0085* (2013.01); *F02F 2200/06* (2013.01)

(56) References Cited

U.S. PATENT DOCUMENTS

| | | | |
|---|---|---|---|
| 4,850,312 | A | 7/1989 | Schwab |
| 5,690,159 | A | 11/1997 | Mizukusa |
| 6,205,959 | B1 | 3/2001 | Smetan et al. |
| 6,415,848 | B1 | 7/2002 | Komazaki et al. |
| 6,418,889 | B1 | 7/2002 | Manabe et al. |
| 6,886,505 | B2 | 5/2005 | Laufenberg et al. |
| 8,820,389 | B1 | 9/2014 | Degler |
| 2002/0100435 | A1 | 8/2002 | Osman |
| 2005/0166396 | A1 | 8/2005 | Brookel et al. |
| 2011/0023799 | A1 | 3/2011 | Lenz et al. |

FOREIGN PATENT DOCUMENTS

| | | | |
|---|---|---|---|
| GB | 809529 | | 2/1959 |
| GB | 2028424 | A | 3/1980 |
| JP | H03462 | A | 1/1991 |
| JP | H05141307 | A | 6/1993 |
| JP | H0970645 | A | 3/1997 |
| JP | 2000042708 | A | 2/2000 |
| JP | 2001107801 | A | 4/2001 |
| JP | 2003065146 | A | 3/2003 |

* cited by examiner

DIE CAST CLOSED DECK ENGINE BLOCK MANUFACTURE

CROSS-REFERENCE TO RELATED APPLICATION

The present application claims the benefit of prior provisional application Ser. No. 62/203,453, filed Aug. 11, 2015, the contents of which are hereby incorporated herein by reference.

BACKGROUND

The present invention relates to a method of die casting to form a closed deck engine block.

In the operation of an internal combustion engine (ICE), the cylinders generate waste heat. To draw away this heat, an interconnected continuous cooling passage known as a water jacket is provided around the cylinders and cooling fluid is circulated through the water jacket to a radiator. In manufacturing an ICE, an engine block may be die cast with a permanent reusable steel mold or "die". The engine block typically forms the cylinder walls—in some cases lined with cylinder liners—and the water jacket around the cylinder walls. The top of the engine block is known as the deck; the crank case is provided at the bottom of the engine block.

In one method of die casting an engine block, steel die core pieces are extended into the die cavity of a permanent steel mold. After die casting, these die core pieces are withdrawn to form a continuous water jacket around the cylinders extending from the deck of the engine block. Later in the manufacturing operations, a cylinder head is joined to the deck of the engine block to cap the cylinders and the water jacket.

With this method of manufacture, after die casting the engine block, the entire water jacket fully opens to the deck. For this reason, this method of manufacture is said to result in an open deck engine block wherein the upper end of the cylinder walls are not connected to the outer walls of the engine block at the deck. Because the engine block is manufactured using a permanent steel mold, melt can be introduced at high pressure and speed into the die cavity allowing an engine block to be formed quickly. Moreover, after forming an engine block, the same die is ready to be reused immediately. Thus, the time to manufacture engine blocks in high volumes is low as compared with other common manufacturing methods. Further, the steel die has a lifespan of many (tens of thousands of) cycles. For all of these reasons, this method of manufacturing allows for the high volume production of engine blocks at a significantly lower cost than that of other common manufacturing methods.

With technological advances and stricter fuel economy standards, there is a need for higher power density (i.e., higher HP/L) ICEs. Higher power density ICEs impart increased pressures and forces to the cylinder walls. This leads to an increase of damaging distortions and vibrations of the freestanding cylinder walls. Therefore, in order to strengthen and support the cylinder walls, manufacturing techniques have been developed to form engine blocks with bridges that extend along the deck between the cylinder walls and the remainder of the engine block. Engine blocks formed with these bridges are known as closed deck engine blocks.

In one approach to manufacturing a closed deck engine block, termed a "lost core" approach, sacrificial cores are positioned within the die cavity of a semi-permanent mold between die core pieces that are extended into the mold. After die casting, the die core pieces are withdrawn leaving the sacrificial cores behind within the engine block casting. These sacrificial cores, which may be formed of sand held together with a binder, can then be broken up and removed from the cast engine block. To facilitate this, the engine block may be formed with holes in its sides that extend to the sacrificial cores. After removal of the sacrificial cores, these holes may be plugged with core plugs. The die core pieces are spaced from one another and the sacrificial cores only intermittently come up to the level of the deck. In consequence, bridges are formed between the cylinder walls and the remainder of the engine block between the die core pieces.

A drawback with this manufacturing approach is that, because the sacrificial cores are relatively fragile, the die casting has to be done at low pressure which slows the cycle time of the die, thereby increasing manufacturing cost. Manufacturing cost is further increased by the fact that the sacrificial cores are lost after each cycle such that they must be replaced after each cycle and due to the additional time needed to properly place the sacrificial cores before casting and break up and remove them after casting.

U.S. Pat. No. 8,820,389 issued Sep. 2, 2014 to Degler describes a lost core manufacturing approach intended to permit high pressure die casting (HPDC). A salt core is molded around a number of cylinder sleeves to create composite cores. The composite cores are then placed within the cavity of a permanent mold. The cylinder sleeve provides support for the salt core to allow HPDC. After casting, the cylinder sleeves of the composite cores are the cylinder walls. The salt cores are then sacrificed (chemically dissolved) to provide the water jacket. As with the low pressure lost core approach, manufacturing costs are increased by the fact the salt cores are lost after each cycle and must be replaced and due to the additional time needed to properly place the sacrificial cores before casting and dissolve and remove them after casting.

A further approach to manufacturing an HPDC closed deck engine block is referred to as the "loose core" approach. With this approach, die core pieces connected to the die are extended into the die cavity so as to surround segments of what will form a cylinder wall and loose die core pieces are inserted between the connected die core pieces. After die casting, the connected die core pieces are withdrawn and the loose die core pieces are knocked out. The loose core pieces form undercuts which interconnect the water jacket around the cylinders and leave bridges between the cylinder walls and the remainder of the engine block along the deck of the engine block. U.S. Pat. No. 6,415,848 issued Jul. 9, 2002 to Komazaki et al. describes an example loose core manufacturing approach.

The loose core manufacturing approach allows HPDC but may leave flash between the loose die core pieces and the connected die core pieces that has to be removed. Further, bridges formed in the loose core approach may need to be fairly narrow in order to facilitate removal of the loose cores. Yet further, the water jacket may need to be enlarged adjacent each deck bridge to provide room to remove the loose core that formed the bridge. Asymmetric water jackets are not preferred due to the less efficient cooling fluid flow patterns through such water jackets. Furthermore, the time to properly locate the loose cores in the die prior to casting and remove them after casting increases manufacturing cost.

SUMMARY

A first die segment for forming an internal combustion engine block has cylindrical projections, and die core pieces disposed about the cylindrical projections. A second die segment has die core stubs positioned so as to extend between adjacent die core pieces when the segments are brought together. An engine block formed by the die segments has cylindrical bores formed by the cylindrical projections extending from the deck of the block and voids formed by the die core pieces also extending from the deck and disposed about the cylindrical bores. Pockets formed by the die core stubs extend into sides of the engine block between adjacent voids. The engine block is worked below the level of the deck to undercut each of the pockets, removing material between them and the voids to result in an interconnected water jacket extending about the cylindrical bores, while leaving the deck closed.

In an aspect, there is provided a method for making an internal combustion engine block, comprising: bringing a metal first die segment and a metal second die segment together to at least partially define a mold cavity shaped as said engine block, said first die segment having a plurality of cylindrical projections and a plurality of die core pieces disposed about said cylindrical projections in spaced relation to each other and in spaced relation to said cylindrical projections; said second die segment having a plurality of die core stubs positioned so as to extend between adjacent die core pieces when said first die segment and said second die segment are brought together; introducing melt to said mold cavity and allowing said melt to solidify to form said engine block; separating said first die segment and said second die segment to release said engine block; said engine block having a plurality of cylindrical bores extending from a deck of said engine block, said cylindrical bores formed by said cylindrical projections, a plurality of at least partially separated voids extending from said deck and disposed about said cylindrical bores, said voids formed by said die core pieces, said voids comprising segments of a water jacket, and a plurality of pockets extending into sides of said engine block between adjacent voids, said pockets formed by said die core stubs; working said engine block below the level of said deck to undercut each of said pockets to remove material between said pockets and said voids in order to form an interconnected water jacket about said cylindrical bores while leaving said deck closed.

In another aspect, there is provided a method for making an internal combustion engine block, comprising: bringing a metal first die segment and a metal second die segment together to at least partially define a mold cavity shaped as an engine block, said first die segment having a plurality of cylindrical projections and a plurality of die core pieces disposed about said cylindrical projections in spaced relation to each other and in spaced relation to said cylindrical projections; said second die segment having a plurality of die core stubs positioned so as to extend between adjacent die core pieces when said first die segment and said second die segment are brought together; introducing melt to said mold cavity and allowing said melt to solidify to form said engine block; separating said first die segment and said second die segment to release said engine block; said engine block having a plurality of cylindrical bores extending from a deck of said engine block, said cylindrical bores formed by said cylindrical projections, a plurality of voids extending from said deck and disposed about said cylindrical bores, said voids formed by said die core pieces, said voids comprising segments of a water jacket, and a plurality of pockets extending into sides of said engine block between adjacent voids, said pockets formed by said die core stubs; said die core stubs dimensioned such that said pockets at least partially interconnect said voids in order to form an interconnected water jacket about said cylindrical bores while leaving said deck closed.

BRIEF DESCRIPTION OF THE DRAWINGS

In the figures which illustrate an example embodiment.

DETAILED DESCRIPTION

Figure 1:
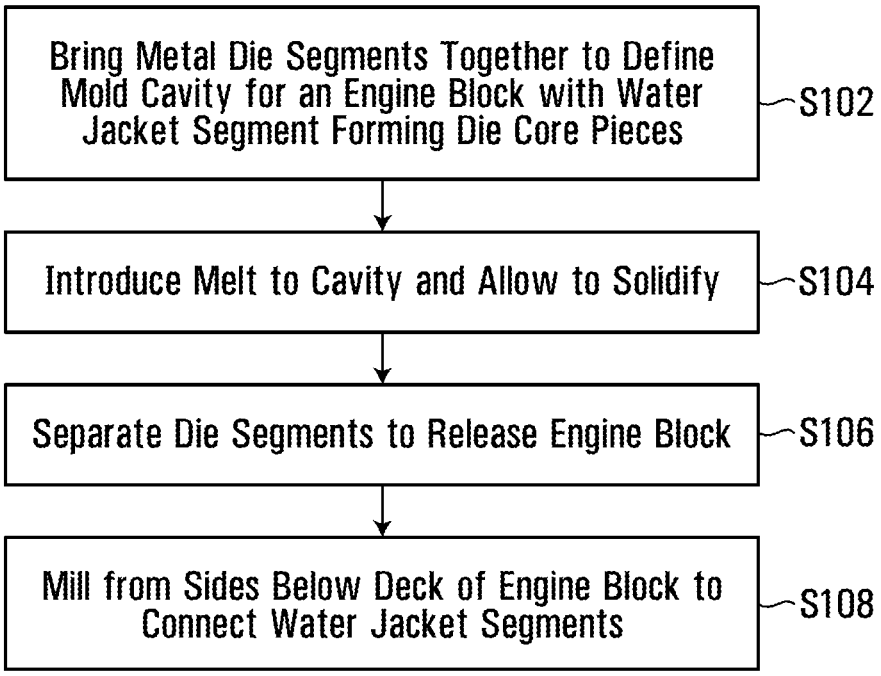
FIG. 1 is a flow diagram of a manufacturing method according to an embodiment.

With reference to FIG. 1, to manufacture an engine block according to an embodiment, metal die segments are brought together to define a mold cavity which has the shape of the engine block (S102). A first die segment of the die has cylindrical projections with die core pieces disposed about these cylindrical projections in spaced relation to each other and in spaced relation to the cylindrical projections. Melt is then introduced to the mold cavity (S104) and allowed to solidify (S104). Advantageously, the melt may be introduced at high pressure (e.g., about 5,000 to about 15,000 psi). The die segments are then separated to release the resulting engine block formed within the mold cavity (S106). The engine block has cylindrical bores formed by the cylindrical projections of the first die segment which extend from a deck at the top of the engine block and, also, separated voids formed by the die core pieces extending from the deck and disposed about the cylindrical bores. These separated voids are segments of a water jacket. The engine block is then milled through its sides below the level of the deck to connect the separated voids in order to form an interconnected water jacket about the cylindrical bores while leaving the deck at the top of the engine block closed (S108).

Figure 2:
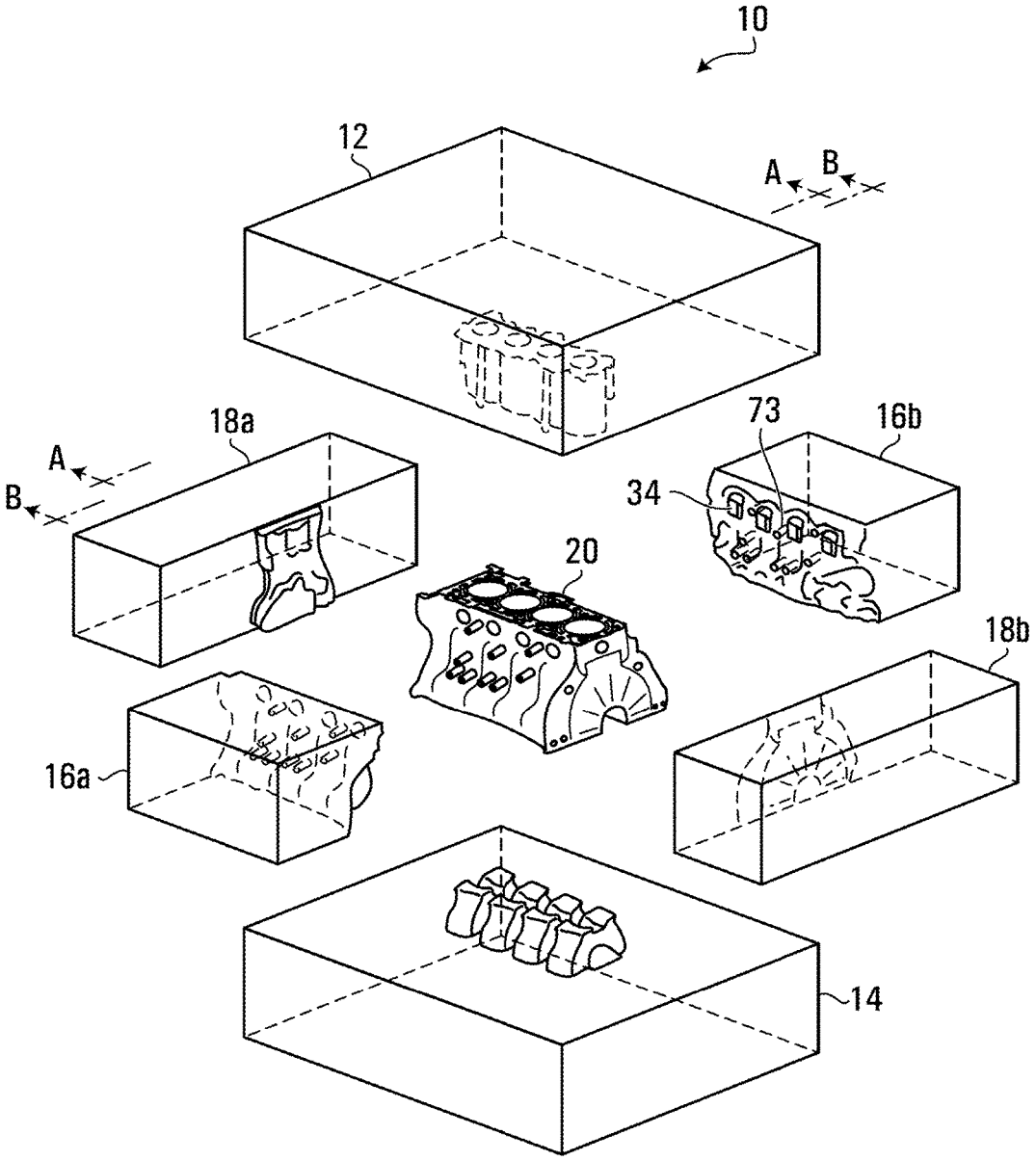
FIG. 2 is an exploded schematic view of a die useful in producing engine blocks in accordance with an embodiment and of an engine block produced by the die.
Figure 3:
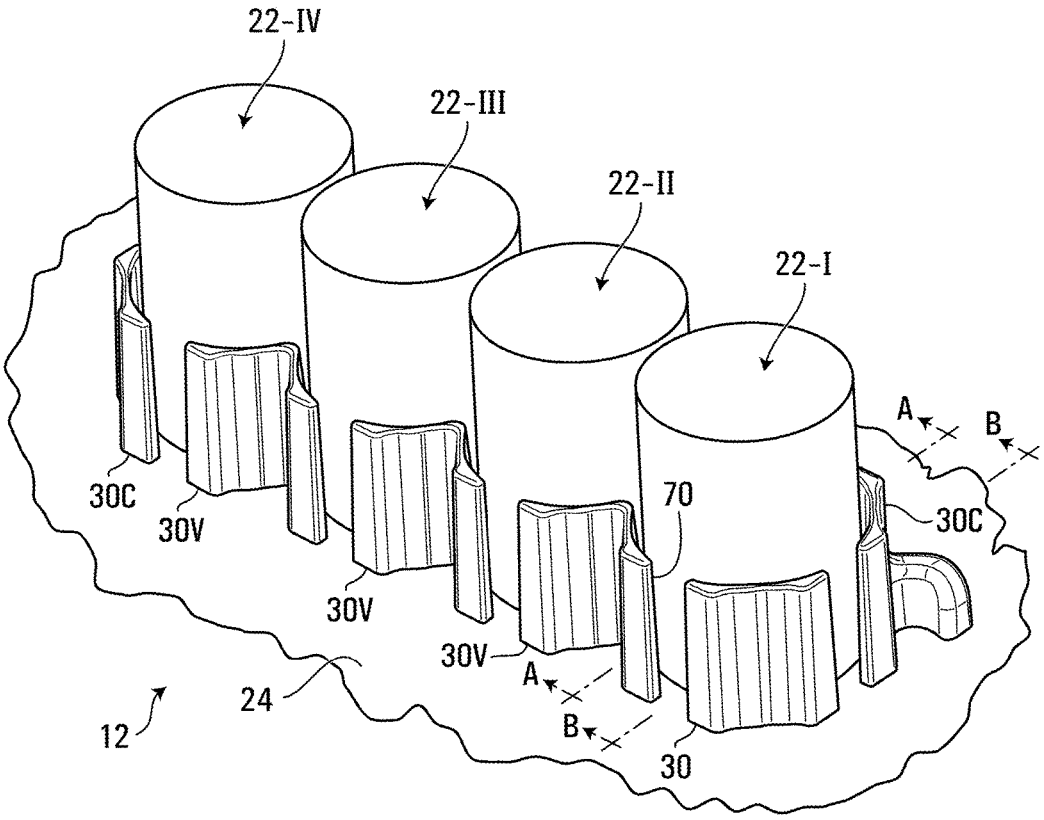
FIG. 3 is a perspective underside partial view of the top die segment of FIG. 2.

A suitable die is schematically illustrated in FIG. 2. Turning to this figure, die 10 has a top (first) die segment 12, a bottom die segment 14, side (second) die segments 16*a*, 16*b*, and end die segments 18*a*, 18*b*. Each of the die segments has a die face for forming features of engine block 20. Features of the die face of the top die segment are illustrated in FIG. 3. With reference to FIG. 3, top die segment 12 has cylindrical projections 22—four in number in this example embodiment: 22-I, 22-II, 22-III, and 22-IV—extending from a back plane 24. Each of the cylindrical projections may receive a cylindrical liner (not shown) to help prevent wear of the cylinder wall formed in the engine block. The top die segment also has die core pieces 30 disposed about the cylindrical projections 22 in spaced relation to each other and in spaced relation to the cylindrical projections. The die core pieces have a lesser height than the cylinders. There are two types of the die core pieces: V-shaped die core pieces 30V which extend between adjacent cylindrical projections with a base of each V-shaped die core piece projecting between adjacent cylindrical projections and curved die core pieces 30C, each extending about a portion of a circumference of the endmost cylindrical projections 22-I, 22-IV.

Figure 4A:
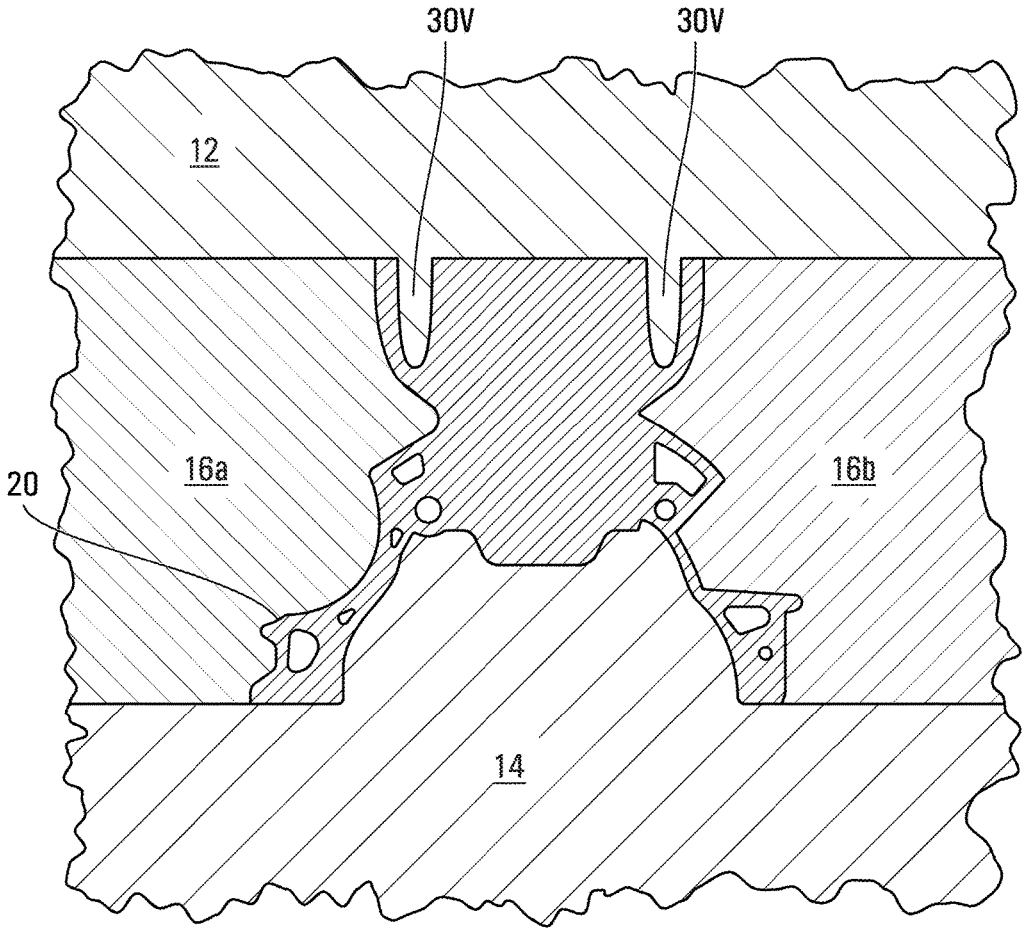
FIG. 4A is a schematic view of the die of FIG. 2 along the plane A-A of FIGS. 2 and 3, but with the die shown in the closed position.
Figure 4B:
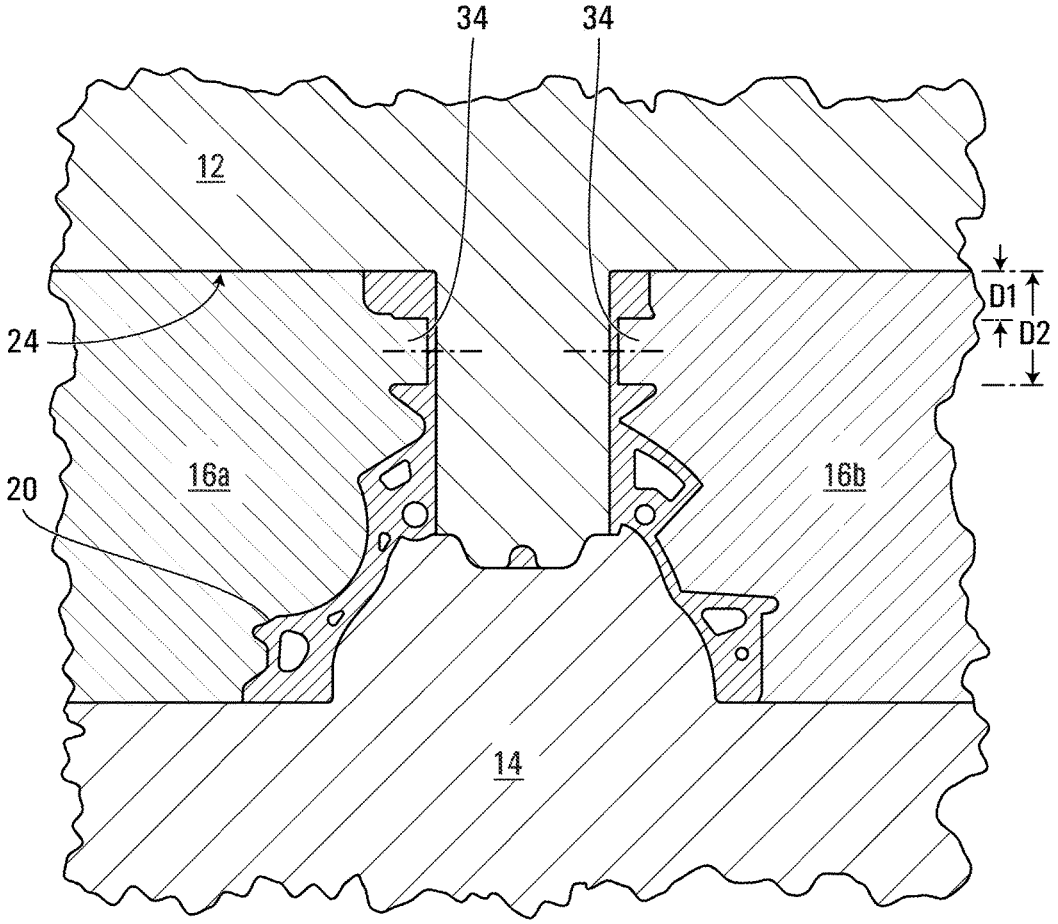
FIG. 4B is a schematic view of the die of FIG. 2 along the plane B-B of FIGS. 2 and 3, but with the die shown in the closed position.

FIG. 4A illustrates a cross-section of the die 10 in a closed position along the plane A-A of FIGS. 2 and 3 which bisects V-shaped die core pieces 30V of the top die segment 12 between cylinders 22-I and 22-II. FIG. 4B illustrates a cross-section of the die 10 in a closed position along the plane B-B of FIGS. 2 and 3 which bisects cylinder 22-I. As illustrated in FIG. 4B, the side die segments 16*a*, 16*b* have cylindrical stubs 34 which extend between the die core pieces 30. These cylindrical stubs 34 project in a direction parallel to the back plane 24 of the top die segment and lie between a first distance D1 and a second distance D2 from back plane 24.

The die segments 16*a*, 16*b* also have female mounting boss forming features 73 (FIG. 2).

The die is arranged such that, with the die closed, there is a clearance between the sides of cylindrical stubs 34 and the sides 70 of the die core pieces.

Figure 5:
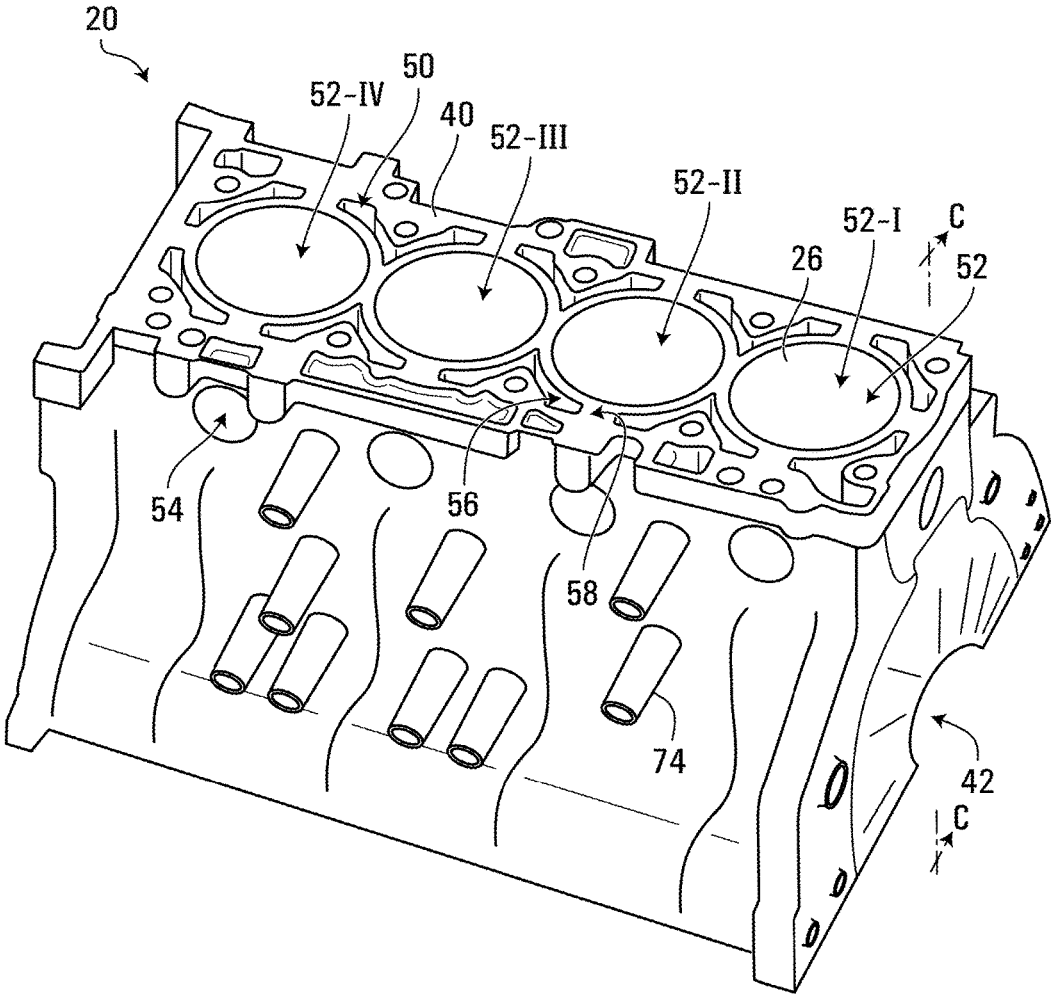
FIG. 5 is a perspective view of an engine block produced by the die casting machine of FIG. 2.

The engine block 20 is formed after melt, advantageously at high pressure, is introduced into the die cavity and solidifies. FIG. 5 illustrates the engine block 20 after it has been removed from the die. The illustrated engine block is an in-line four cylinder engine block, but of course the molding approach can be used for in-line cylinder blocks with differing numbers of cylinders as well as with engine blocks with cylinders disposed in a V configuration. The top face of the engine block 20 is a deck 40 and the bottom of the block is a crank case 42. Cylinders 52—namely cylinders 52-I, 52-II, 52-III, and 52-IV—extend from the deck to the crank case of the engine block. The engine block also has blind voids 50 which extend from the deck into the block formed by each of the die core pieces 30 of the top die segment 12. These voids are disposed about the cylinders 52 and are separated from each other. In consequence, each cylinder 52 is defined by a cylinder wall 56 connected to the remainder of the engine block by webs 58 that extend between adjacent voids 50. As will become apparent, the voids 50 are disconnected segments of a water jacket.

The block has cylindrical pockets 54 in its side walls formed by the cylindrical stubs 34 of die segments 16*a*, 16*b*. These cylindrical pockets extend between adjacent voids 50 below the level of the deck 40. Because of the clearance between the cylindrical stubs 34 and the sides 70 of the die core pieces of the die 10, the cylindrical pockets are blind holes.

The block also has mounting bosses 74 projecting from the sides of the engine block which were formed by the mounting boss forming features 73 of the die segments 16*a*, 16*b*. These mounting bosses can support tie downs to mount various parts to the engine block, such as hoses and other tubing, cables, electronics, and a water pump. Some of these bosses are positioned on the engine block so as to lie at least partially within the zone between distance D1 and distance D2. Other features can also be cast into the engine block, such as a portion of an oil filter housing. These other features can also extend partially or completely within the zone between distance D1 and D2. Thus, the method of forming the engine block does not preclude positioning mounting bosses or other features between the pockets 54.

Figure 6:
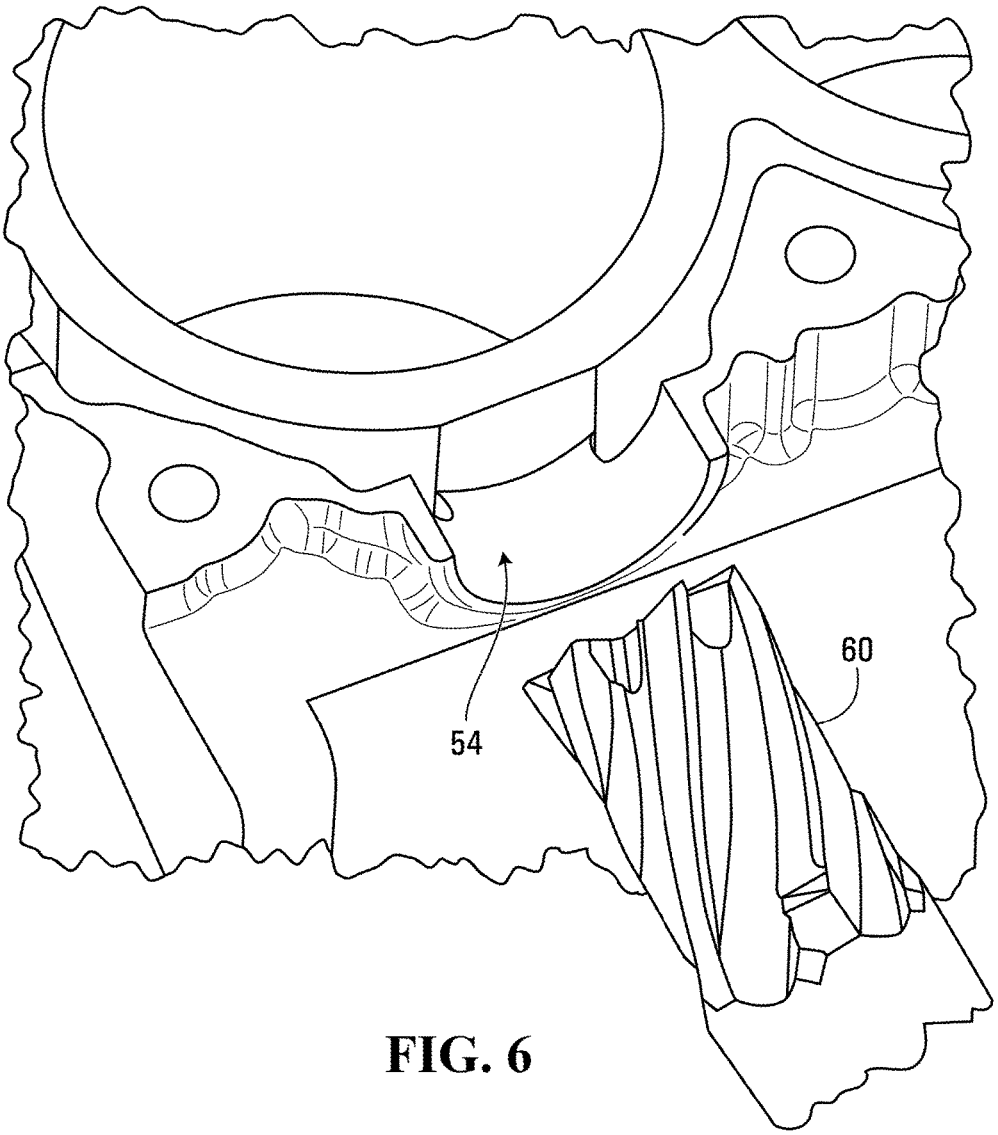
FIG. 6 is a sectioned perspective partial view of the engine block of FIG. 5 undergoing a milling operation.

With reference to FIG. 6, an end mill 60 is used to ream out each of the cylindrical pockets 54 in order to remove draft material to make each pocket more uniformly cylindrical for later plugging with a core plug, and to remove thin material cast in the clearance between opposing die segments. FIG. 6 illustrates the engine block after milling with the end mill.

Figure 7:
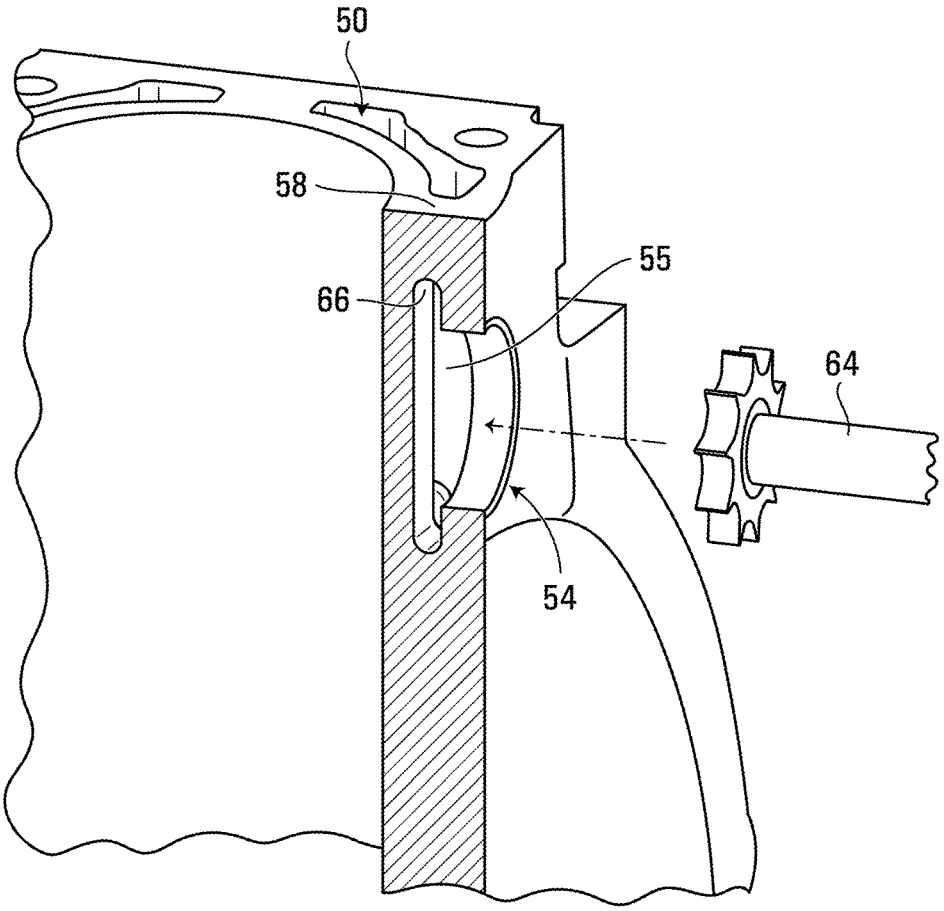
FIG. 7 is a sectioned perspective partial view along the plane C-C of the engine block of FIG. 6 undergoing a further milling operation.

Next, with reference to FIG. 7, a woodruff cutter (T-cutter) 64 is inserted in each of the cylindrical pockets and moved up and down and side-to-side to remove material between each cylindrical pocket and the water jacket segments on either side of the cylindrical pocket in order to join the water jacket segments on each side of the cylindrical pocket 54. In this way, an undercut 66 is formed at a base (blind end) 55 of each pocket that extends between the water jacket segments 50 on either side of each pocket such that the water jacket becomes interconnected around each cylinder. More specifically, the cutter can be moved linearly upwardly toward the deck to form undercut 66 under web 58, initially with a curved upper end wall, then linearly side-to-side so that the upper end wall of the undercut is milled flat (i.e., not curved). The undercut 66 may be extended by moving the cutter linearly downwardly and then side-to-side to form a flat lower end wall. Forming the undercut with flat end walls improves fluid flow through the water jacket.

It is typically not necessary to meet tight tolerances with the woodruff cutter milling operations.

With any approach to making an engine block, after die casting there are certain machining operations needed. With an in-line cylinder engine block this machining is in the same walls and at the same angles as those in which it is necessary to form the undercuts to join the water jacket segments; with a V engine, some of the walls are the same. Consequently, the added cost to form these undercuts with milling operations is moderated by the fact that all, or at least some of, the machining set-up is necessary in any event.

Figure 8:
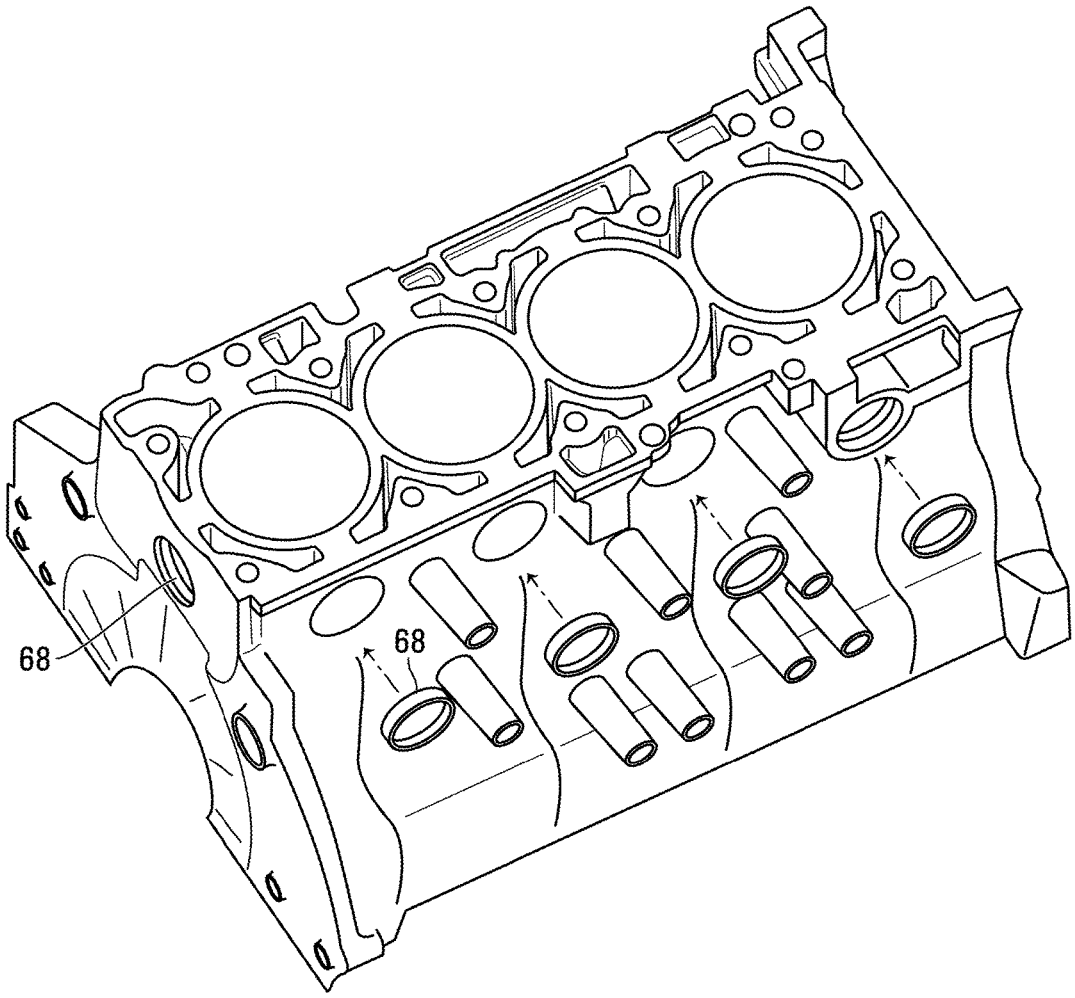
FIG. 8 is a perspective view of the engine block of FIG. 7 with core plugs installed.

Turning to FIG. 8, after these milling operations, core plugs 68 (also known as frost plugs) are used to plug the holes that extend into the water jacket from the sides.

This approach may be used for producing an HPDC closed deck engine blocks at a relatively low cost, indeed, it may allow production of closed deck engine blocks at a cost similar to that of the HPDC method to produce open deck engine blocks.

If pockets 54 which are only roughly cylindrical can be tolerated—such as where suitable fittings are available to plug the roughly cylindrical pockets—it may be possible to dispense with the end milling operation.

It may also be possible to form pockets which have other shapes, such as pockets with a square profile.

In another embodiment, die 10 is arranged such that, with the die closed, the clearance between the sides of cylindrical stubs 34 and the sides 70 of the die core pieces 30 is small or non-existent. With this embodiment, the material between each cylindrical pocket 54 and the water jacket segments on either side of the pocket will be very thin, and the pocket may even partially connect to the water jacket segments on either side of the pocket. Thus, an engine block formed by such a modified die may have water jacket segments which are connected at least to some degree. With this embodiment, because the material between the cylindrical pockets and water segments is thin, it may be possible to remove this material by trimming with a punch rather than with milling operations. The punch may be inserted through the cylindrical pockets or through the voids from the deck in order to reach the material to be trimmed.

Other modifications will be apparent to those skilled in the art and, therefore, the invention is defined in the claims.

What is claimed is:

1. A method for making an internal combustion engine block, comprising:

bringing a metal first die segment and a metal second die segment together to at least partially define a mold cavity shaped as said internal combustion engine block, said first die segment having a plurality of cylindrical projections and a plurality of die core pieces disposed about said cylindrical projections in spaced relation to each other and in spaced relation to said cylindrical projections;

said second die segment having a plurality of die core stubs positioned so as to extend between adjacent said die core pieces when said first die segment and said second die segment are brought together;

introducing melt to said mold cavity and allowing said melt to solidify to form an unworked engine block;

separating said first die segment and said second die segment to release said unworked engine block;

said unworked engine block having a plurality of cylindrical bores extending from a deck of said unworked engine block, said cylindrical bores formed by said cylindrical projections, a plurality of at least partially separated voids extending from said deck and disposed about said cylindrical bores, said voids formed by said die core pieces, said voids comprising segments of a water jacket, and a plurality of blind holes extending into sides of said unworked engine block, each blind hole having a blind end and extending between two said voids of a pair of adjacent said voids, said blind holes formed by said die core stubs;

working said unworked engine block below the level of said deck by inserting a tool along a depth direction and into said each blind hole and cutting into said engine block at said blind end of said each blind hole in a direction transverse to the depth direction such that said each blind hole has a greater dimension in the direction transverse of the depth direction at said blind end than in the direction transverse to the depth direction at a mouth of said each blind hole, whereby said working undercuts a wall defining said each blind hole at said each blind end and forms an interconnected water jacket about said cylindrical bores while leaving said deck closed to thereby form said internal combustion engine block.

2. The method of claim 1 wherein said working comprises milling.

3. The method of claim 2 further comprising, subsequent to said milling, plugging said blind holes with core plugs.

4. The method of claim 2 wherein said milling comprises milling with a woodruff cutter.

5. The method claim 4 wherein said milling with a woodruff cutter comprises moving said woodruff cutter in a first linear direction transverse to the depth direction and toward said deck to an endpoint in order to at least partially form an undercut.

6. The method of claim 5 wherein after moving said woodruff cutter in said first linear direction, said undercut has an end wall which is curved and further comprising subsequently moving said woodruff cutter back and forth in a second linear direction transverse to the depth direction and transverse to said first linear direction such that said end wall of said undercut is flat.

7. The method of claim 6 further comprising milling with an end mill prior to milling with said woodruff cutter.

8. The method of claim 1 wherein said first die comprises a back plane from which said cylindrical projections and said die core pieces project.

9. The method of claim 8 wherein, when said first die segment and said second die segment are brought together, said die core stubs parallel said back plane and are spaced from said back plane.

10. The method of claim 1 wherein said working comprises trimming.

11. The method of claim 1 wherein said die core stubs are cylindrical stubs such that said blind holes are cylindrical blind holes.

12. The method of claim 8 wherein, after said first die segment and said second die segment are brought together, at least one of said die core stubs is set back a first distance from said back plane of said first die segment and extends to a further, second distance from said back plane and wherein said second die segment has a plurality of mounting boss forming features for forming mounting bosses on sides of said engine block, at least one of said mounting boss forming features positioned such that after said first die segment and said second die segment are brought together, at least a portion of said at least one of said mounting boss forming features lies between said first distance and said second distance.

13. The method of claim 1 wherein said die core pieces comprise V-shaped die core pieces which extend between adjacent said cylindrical projections with a base of each V-shaped die core piece projecting between adjacent said cylindrical projections and curved die core pieces extending about a portion of a circumference of each endmost cylindrical projection.

* * * * *